US006220118B1

(12) United States Patent
Pacheco et al.

(10) Patent No.: US 6,220,118 B1
(45) Date of Patent: Apr. 24, 2001

(54) BEAUTY NAIL SAVER POP TAB OPENER

(76) Inventors: Victor M. Pacheco; Marlinette Pacheco, both of 86 William St. 2nd Fl., New Haven, CT (US) 06511

( * ) Notice: Subject to any disclaimer, the term of this patent is extended or adjusted under 35 U.S.C. 154(b) by 0 days.

(21) Appl. No.: 09/434,019

(22) Filed: Nov. 4, 1999

(51) Int. Cl.[7] ..... B67B 7/16
(52) U.S. Cl. ..... 81/3.55
(58) Field of Search ..... 81/3.41, 3.55, 81/3.57, 177.3

(56) References Cited

U.S. PATENT DOCUMENTS 312,221 * 2/1885 Pruim ..... 7/101
952,085 * 3/1910 Stephens ..... 215/226
4,207,781 * 6/1980 Greenwood ..... 81/3.55
4,631,769 * 12/1986 White ..... 7/151
5,337,632 * 8/1994 Thomas et al. ..... 81/3.55
5,509,380 * 4/1996 Tipp ..... 81/3.55
5,555,778 * 9/1996 Otters et al. ..... 81/3.55
5,644,848 * 7/1997 Totten ..... 30/450
5,771,759 * 6/1998 Warren ..... 81/3.09

* cited by examiner

*Primary Examiner*—James G. Smith
*Assistant Examiner*—David B. Thomas

(57) ABSTRACT

A thin, metal device, comprising of a lever (10) facilitating the opening of flip-top cans. The lever has a bend (18) sloping downwardly from the rear and converging with a bend (20) that slopes upwardly and leads to a bend forming a scoop (22). The bend forming a scoop comprises on both sides a chamfered edge 26, a dip 24, and a tapered corner (28). A head (30) extends upwardly so that the lever will slide under the can tab, enter the arcuate slot and join at the base of the tab. The base of the tab serves as a fulcrum for pivoting upwardly thus rotates the tab. After opening the can, a tab-retracting arm (32) centered on top lowers the tab. A key ring (34) interlocks through a hole (12), conveniently. For extra control, the pop tab opener can be adapted with a thumb-size ring attachment (36).

5 Claims, 4 Drawing Sheets

BEAUTY NAIL SAVER POP TAB OPENER

SUMMARY

In accordance with present invention the Beauty Nail Saver™ pop tab opener, created by Victor and Marlinette Pachcco of New Haven, comprises a thin, metal device, comprising of a lever for rotating the tab. The can opener has a bend forming a scoop having a head at the end extending upwardly. The lever has a key ring, a tab-retracting arm, a chamfered edge and a tapered corner on both sides at the end portion. Additional embodiment is a thumb-size ring attachment.

Objects and Advantages

Accordingly, several objects and advantages of the present invention are:

(a) to provide an easy way to open flip-top cans for people who have (1) Very short nails, (2) Long nails, (3) Arthritis or debilitating diseases, and (4) Senior Citizens;

(b) to provide an easy way to carry along with keys;

(c) to provide an easy way to open mail;

(d) to provide an easy way to open processed food packages;

(e) to provide an easy way to sanitize being that it is made of stainless steel;

(f) to provide an easy way to identify the can opener with beauty and health cosmetics as well as houseware products;

(g) to provide a multipurpose, highly reliable, convenient, lightweight, durable, safe, yet economical device that can be used by persons of all ages.

Further objects and advantages of the pop tab opener are a thumb-size ring attachment, which provides maximum control and mobility for the very busy person, for example, the airline flight attendant. Still further objects and advantages will become apparent from a consideration of the ensuing description and drawings.

DRAWING FIGURES

In the drawings, closely related figures have the same number but different alphabetic suffixes.

Reference Numerals In Drawings

| | |
|---|---|
| 10 lever | 12 hole |
| 14 knurled corner | 16 knurled edge |
| 18 bend | 20 bend |
| 22 bend forming a scoop | 24 dip |
| 26 chamfered edge | 28 tapered corner |
| 30 head | 32 tab-retracting arm |
| 34 key ring | 36 thumb-size ring attachment |
| 38 hinge screw post | |

DESCRIPTION

Figure 1:
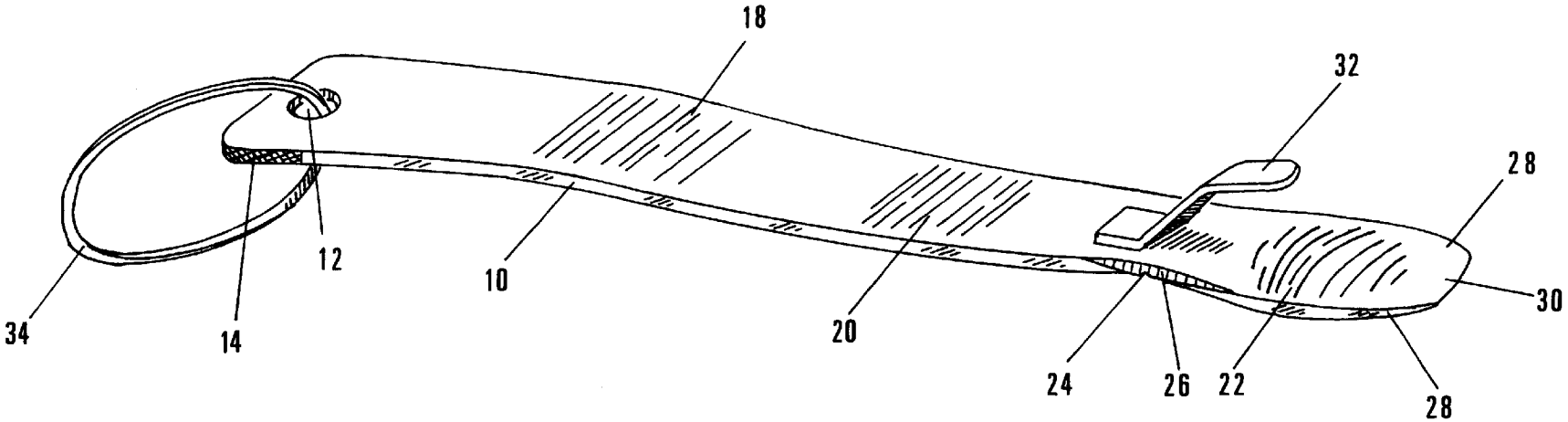
FIG. 1 shows a perspective view of the pop tab opener with a key ring.
Figure 2A:
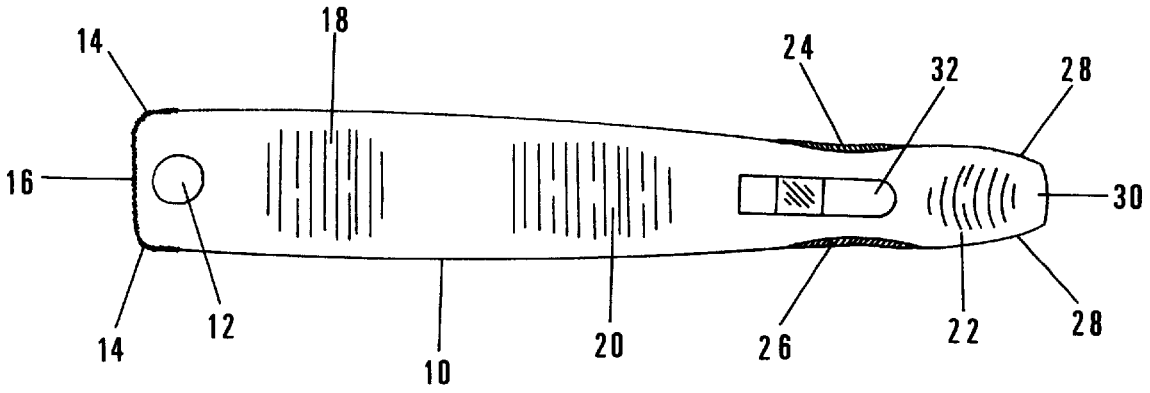
FIGS. 2A and 2B show various aspects of the pop tab opener.
Figure 2B:
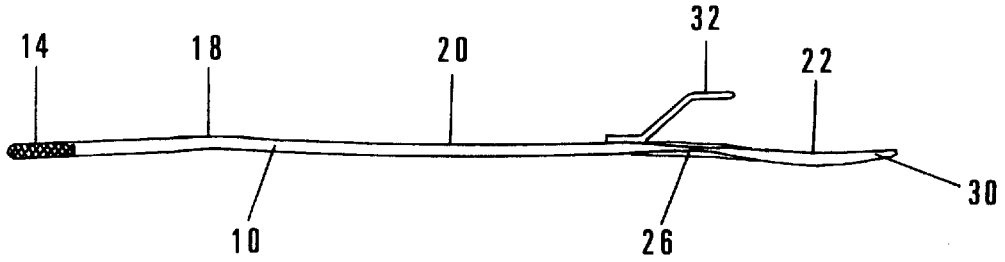

FIGS. 1 thru 2B—Primary Embodiment

A primary embodiment of the pop tab opener of the present invention is illustrated in FIG. 1 (a perspective view), FIG. 2A (top view) and FIG. 2B (side view). The can opener device perferably is made of stainless steel. The device is a lever 10 of about 3.5 inch (9 cm) long and having a cross section of approximately 9/16 inch (1.4 cm) wide at the aft section. The aft section comprises of a key ring 34 interlocking through a hole 12 (FIG. 1). Hole 12 is approximately 3/16 inch (5 mm) diameter and drilled near the aft edge and centered as shown in FIG. 2A. A knurled corner 14 and a knurled edge 16 are formed along the aft section outer edge. Lever 10 has a thickness of about 1/16 inch (1.6 mm). A bend 18 of lever 10 slopes downwardly along the longitudinal axis beginning at about 3/4 inch (2 cm) from the aft edge. Bend 18 converges with a bend 20 that slopes upwardly and leads to a bend forming a scoop 22. Bend forming a scoop 22 having an inclination beginning at the end of the lever has a cross section of at least 3/8 inch (1 cm).

The can opener device at the end has a head 30 having a taper terminus of approximately 3/16 inch (5 mm) wide extending upwardly (FIGS. 2A and 2B). Head 30 is the end portion of bend forming a scoop 22. The head converges rearward with a tapered corner 28 on the left and right side. Tapered corner 28 curves outwardly to a cross section of at least 3/8 inch (1 cm) as shown in FIG. 2A. Where bend 20 and bend forming a scoop 22 converge a chamfered edge 26 having a dip 24 is formed (FIGS. 2A and 2B).

A tab-retracting arm 32 having two oblique angles of about 45 degrees is attached to the lever. Tab-retracting arm 32 extends over about halfway of bend forming a scoop 22 and substantially spaced and facing the end. The base of the tab-retracting arm is centered on top of the lever just before the bend forming a scoop by bend 20 (FIG. 2A).

Figure 3A:
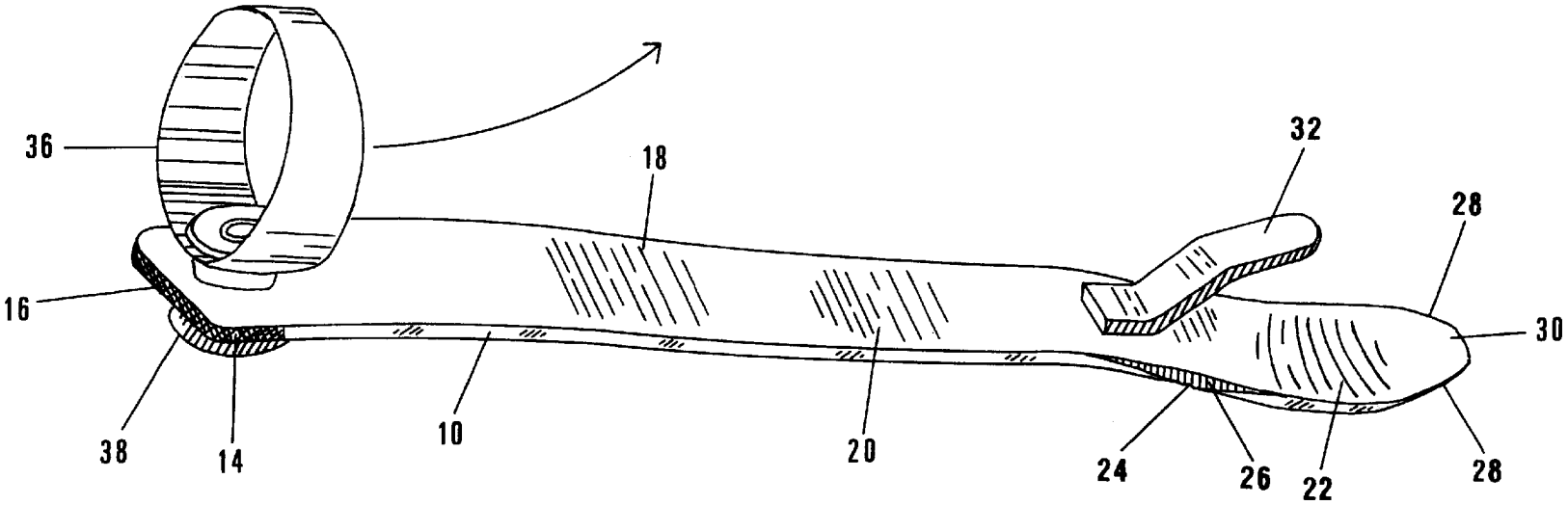
FIG. 3A shows the pop tab opener with a thumb-size ring attachment.
Figure 3B:
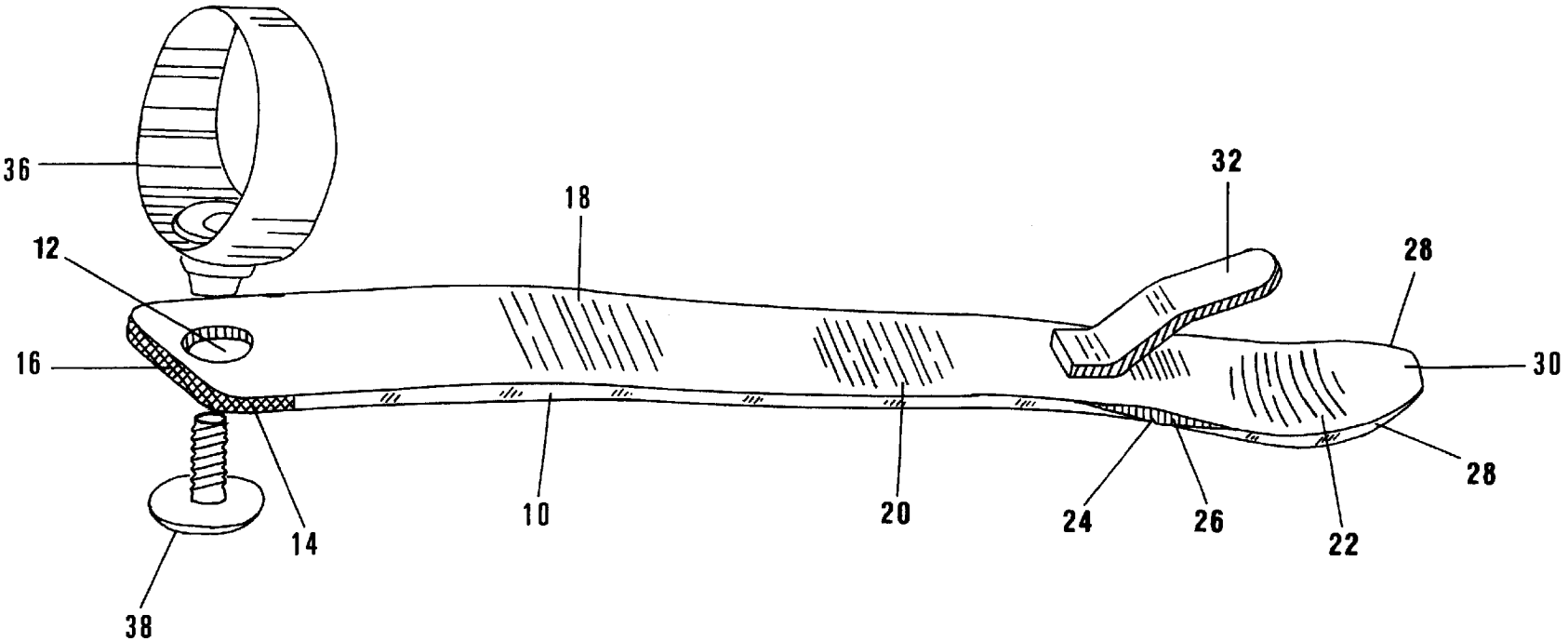
FIG. 3B is a view in detail of the portion indicated in FIG. 3A.

FIGS. 3A–3B—Additional Embodiment

Additional embodiment of the pop tab opener is a thumb-size ring attachment 36 as shown is FIG. 3A. Thumb-size ring attachment 36 is specially adapted with a hinge screw post 38 into the body of the ring as shown in FIG. 3B. Hinge screw post 38 fits through hole 12.

Advantages

From the description above, a number of advantages of our pop tab opener become evident:

(a) The stainless steel construction of our can opener assembly, preferred material, will provide a superior surface thus making it very appealing, dependable, and safer to use by persons of all ages.

(b) The dimensions of our can opener will provide a highly visible but fashionable too, and superior performance.

(c) The use of a thumb-size ring attachment will provide an easier grip when handled with wet or greasy fingers. Also, when handling you can still serve drinks without releasing tool by rotating the can opener inward toward the palm of the hand. And, rotate outward to open a flip-top can when necessary. Various sized of a thumb-size ring attachment will provide a proper fit for females and males. Therefore, a thumb-size ring attachment will provide an efficient customer base service, particularly, to airline flight attendants, etc.

(d) Although a thumb-size ring attachment is optional you can install it permanently then our can opener can be utilized as necessary in the kitchen room thus becoming a kitchen utensil.

(e) The presence of a tab-retracting arm will permit the lowering of the tab after opening the can without having to touch the tab with your finger.

(f) The presence of a chamfered edge will provide the opening of mail conveniently, and is safer than a typical letter opener.

(g) Our can opener will provide both cosmetic and household service needs.

Operation—FIGS. 1, 2, 3

The manner in which to use the pop tab opener of the present invention is to hold the device so that the longitudinal axis of lever 10 is generally in the direction of the index finger, and the thumb in the direction perpendicular to the longitudinal axis, for example, like holding a spoon. The can opener is positioned underneath the can tab outer edge and moved through the arcuate slot until it joins at the base of the tab. The can opener is then moved upwardly to rotate the tab. The presence of head 30 extending upwardly from bend forming a scoop 22 allows the lever to slide under the can tab, enter the arcuate slot and over or past the rivet of the tab with ease. The presence of bend forming a scoop 22 having an inclination beginning at the end serves for interlocking the lever to the tab. The presence of bend forming a scoop 22 having a cross section of at least ⅜ inch (1 cm) is for limiting insertion of the lever through the arcuate slot of the tab. Whereby, the end of the lever will join at the base of the tab. The presence of head 30 having a taper terminus of approximately 3/16 inch (5 mm) wide provides an adequate fit for the lever at the base of the tab for pivoting whereby the base of the tab serves as a fulcrum for the lever. Next, the urging action of the lever in an upwardly direction will open the flip-top can.

It is recommended that lever 10 be not less than 3.5 inch (9 cm) long, anything less will reduce performance.

After opening the can, the presence of tab retracting arm 32 engages the standing tab upon lowering the lever thus lowers the tab.

The presence of chamfered edge 26 facilitates opening of letter envelopes by a sawing motion of the lever. One on each side is provided for left and right handed people (FIG. 2A). The presence of dip 24 that is also chamfered acts as a starter facilitates this process of cutting.

The presence of hole 12 interlocks key ring 34 for convenience; however, there will be times when the demand for extra control and mobility are strongly desired. For this, the presence of thumb-size ring attachment 36 will be needed.

The manner in which the can opener is held will this attachment is identical to the above description in the first paragraph except the user's thumb is placed into the ring. The presence of hinge screw post 38 of thumb-size ring attachment 36 facilitates installation of ring to the lever through hole 12. Whereby, hinge screw post 38 allows rotation of the can opener in any direction. The rotation is controlled by the index finger by using knurled corner 14 and knurled edge 16 for steering the lever (FIG. 3A). The presence of knurled corner 14 and knurled edge 16 provides better grip for the index finger to rotate the can opener.

Conclusion, Ramifications, and Scope

Accordingly, the reader will see that the pop tab opener of this invention can be used to open any flip-top cans easily and conveniently, can be adapted just as easily from a key ring accessory to a household kitchen utensil. Furthermore, the can opener has the additional advantages in that many other applications and variations are possible. For example they are

- a bottle opener using a modified ring attachment to fit on caps with the lever providing a cantilever beam for leverage;
- a utility and utensil tool attachment for handicap persons;
- a nail file manicure tool;
- a vegetable peeler using a modified singe wire centered on lever;
- a orange peeler starter;
- a nut picker; and
- a utility tool attachment for NASA space-suit glove.

Although the description above contains much specificity, these should not be construed as limiting the scope of the invention but as merely providing illustrates of some of the presently preferred embodiments of this invention. For example, the tab-retracting arm can be formed during the metal stamping process instead of being attached and have a notch for locking any special attachments to the lever, thus further enhancing the multipurpose use of our can opener.

Thus the scope of the invention should be determined by the appended claims and their legal equivalents, rather than by the examples given.

We claim:

1. A pop tab opener for opening flip-top cans with ease, comprising:

(a) a lever of rigid material of sufficient size having a thin and narrow cross section, (b) a bend forming a scoop having an inclination beginning at the end of the lever, (c) said lever of rigid material preferably is made of stainless steel about 3.5 inch (9 cm) long having a cross section of approximately 9/16 inch (1.4 cm) wide at the aft section and having another cross section of at least ⅜ inch (1 cm) by said bend forming a scoop, and a thickness of about 1/16 (1.6 mm), (d) a tab-retracting arm, (e) a head of sufficient size to fit at the base of the tab extending upwardly at the end of said bend forming a scoop converging rearward with a tapered corner on the left and right side, and (f) said tab-retracting arm is centered on top of the lever just before the bend forming a scoop having two oblique angles of about 45 degrees and extending over about halfway thereof and substantially spaced and facing the end, whereby said lever fits underneath the can tab, enters the arcuate slot and over or past the rivet and joins at the base of the tab and pivots thereof in an upwardly direction facilitating the opening of flip-top cans, easily and conveniently.

2. The pop tab opener of claim 1 wherein said lever having a head of sufficient size to fit at the base of the tab has a taper terminus of approximately 3/16 inch (5 mm) wide to provide an adequate fit for the lever at the base of the tab for pivoting whereby the base of the tab serves as a fulcrum for the lever.

3. The pop tab opener of claim 1 wherein said bend forming a scoop having said head extending upwardly so that the lever will slide under the can tab, enter the arcuate slot and over or past the rivet of the tab with ease.

4. The pop tab opener of claim 1 wherein said bend forming a scoop having an inclination beginning at the end serves for interlocking the lever to the tab, and having a cross section of at least ⅜ inch (1 cm) for limiting insertion through the arcuate slot so that said head will join at the base of the tab.

5. The pop tab opener of claim 1 wherein said tab-retracting arm is centered on top of the lever extending over about halfway of said bend forming a scoop and substantially spaced from the lever, whereby the tab-retracting arm engages the standing tab upon lowering the lever thus lowers the tab, conveniently.

* * * * *